United States Patent [19]

French

[11] Patent Number: 4,836,440

[45] Date of Patent: Jun. 6, 1989

[54] SIFT-PROOF CARTON AND METHOD OF MANUFACTURE

[75] Inventor: Gordon K. French, Atlanta, Ga.

[73] Assignee: Nordson Corporation, Amherst, Ohio

[21] Appl. No.: 7,593

[22] Filed: Jan. 28, 1987

Related U.S. Application Data

[63] Continuation-in-part of Ser. No. 848,737, Apr. 4, 1986, abandoned.

[51] Int. Cl.[4] ..... B65D 5/66

[52] U.S. Cl. ..... 229/132; 206/611

[58] Field of Search ..... 229/132, 3.1, 48 T, 229/44 R, 136, 125.33; 206/611

[56] References Cited

U.S. PATENT DOCUMENTS

| | | | |
|---|---|---|---|
| 2,217,757 | 10/1940 | Lindley . | |
| 2,341,845 | 2/1944 | Mark et al. . | |
| 2,496,043 | 1/1950 | Farrell . | |
| 2,986,321 | 5/1961 | Schaich . | |
| 3,077,064 | 2/1963 | Russell . | |
| 3,140,809 | 7/1964 | Hickin et al. . | |
| 3,194,473 | 7/1965 | Rumberger . | |
| 3,286,906 | 11/1966 | Rumberger | 229/132 |
| 3,291,368 | 12/1966 | Hess . | |
| 3,297,229 | 1/1967 | Bluem . | |
| 3,341,105 | 9/1967 | Curran | 229/132 |
| 3,511,431 | 5/1970 | Silver . | |
| 3,586,232 | 6/1971 | Scully . | |
| 3,831,342 | 8/1974 | Rejsa . | |
| 3,951,332 | 4/1976 | Torbeck | 206/611 |
| 4,059,466 | 11/1977 | Scholl et al. . | |
| 4,156,398 | 5/1979 | McDaniel . | |
| 4,396,529 | 8/1983 | Price et al. . | |

FOREIGN PATENT DOCUMENTS

| | | |
|---|---|---|
| 1520240 | 4/1968 | France . |
| 1453937 | 10/1976 | United Kingdom . |

OTHER PUBLICATIONS

"Packaging", vol. 29, No. 8, Jul. 1984, p. 17.

*Primary Examiner*—Willis Little

*Attorney, Agent, or Firm*—Wood, Herron & Evans

[57] ABSTRACT

A four-sided, sift-proof carton and method of sealing the end flaps of same includes two minor flaps and an inner and outer major flap at the top and bottom of the carton. The inner and outer major flaps are each formed with a width less than the depth of the carton so that when folded a space or gap is formed beneath the outer major flap between the leading edge of the inner major flap and the fold line of the outer major flap. A sift-proof seal is formed between the flaps by applying ribbons or strips of foamed hot melt adhesive along the outer ends of the inner major flap which is folded atop the minor flaps, and by applying strips of foamed hot melt adhesive in a block C shape onto the ends and middle of the outer major flap which is folded atop the minor flaps and inner major flap. The strips of foamed hot melt adhesive at the ends of the outer major flap fill the gap along the minor flaps between the leading edge of the inner major flap and fold line of the outer major flap to create a sift-proof seal without the inner major flap extending completely across the top or bottom of the carton.

4 Claims, 3 Drawing Sheets

SIFT-PROOF CARTON AND METHOD OF MANUFACTURE

RELATED CASES

This is a continuation-in-part application of U.S. patent application Ser. No. 06/848,737, filed Apr. 4, 1986, which is entitled "Sift-Proof Carton and Method of Manufacture", now abandoned.

BACKGROUND OF THE INVENTION

This invention relates to sift-proof cartons and the method of manufacturing same, and, more particularly, to a carton having shortened end flaps and the method of sealing the end flaps with foamed hot melt adhesive to provide a sift-proof seal.

Hot melt thermoplastic adhesives are commonly used in applications such as packaging and cartoning where the quick setting time of this type of adhesive is advantageous. At the high operating speeds of commercial cartoning machines, the use of chemical or cold adhesives has decreased because of the relatively long setting time required for such adhesives. Hot melt adhesive applied to the flaps of a carton sets relatively quickly and substantially reduces the time in which compressive forces must be applied to the flaps while the adhesive bonds as compared to cold glue.

Despite the improvement over cold adhesives, hot melt thermoplastic adhesives also present problems in packaging and cartoning applications. One of the most common problems with hot melt adhesives is that of compressing the adhesive after application so as to obtain sufficient surface contact between the adhesive and adhered substrate to achieve a good bond. The relatively high viscosity, high surface tension, and quick setting time of hot melt adhesives all combine to prevent the adhesive from spreading over a large surface area when the adhesive is applied as a liquid to the substrate. Instead of spreading, the liquid sets up as a thick bead on the structure. Even when quickly compressed between two flaps of a carton, the adhesive has been found difficult to spread. In most instances, when the two flaps which have been adhered together are pulled apart, the bond breaks the adhesive-to-substrate interface. This means that in order to increase the strength of the bond, the area of the interface or surface contact between the adhesive and substrate must be increased.

As described in detail in U.S. Pat. No. 4,059,466, assigned to the assignee of this invention, it has been discovered that the adhesive strength of a bond achieved with a given quantity of hot melt adhesive may be appreciably improved if the adhesive is applied as a cellular foam rather than as a conventional non-foamed adhesive. A method of making and applying foamed hot melt adhesive is described in detail in U.S. Pat. No. 4,059,466. The increased bonding strength of the foamed adhesive results at least in part from the fact that the foamed adhesive may be spread over at least twice the area as the same adhesive in the non-foamed state under the same compressive conditions. Since the strength of the bond is a function of the area wetted or covered by the adhesive, foaming of adhesive results in a bond approximately twice as strong as the same quantity of adhesive unfoamed. Expressed another way, the same bond strength may be achieved with approximately half the quantity of foamed adhesive as unfoamed adhesive because of the much larger area wetted or covered by the unfoamed adhesive under the same compressive conditions.

So-called sift-proof cartons are usually fabricated by applying a block C or block U-shaped pattern of adhesive to the end flap structure of a four-sided carton to form a continuous line or bead of adhesive along the carton edges to eliminate any minute channels or openings through which granular material in the carton could leak. In one type of four-sided carton, for example, the four flaps at each end of the carton include a pair of opposed minor flaps, and an inner major flap and outer major flap which are each formed with a width equal to the depth of the carton. In sealing the end flaps of such four-sided, sift-proof carton, the opposed minor flaps are first folded inwardly toward the center of the carton. The two major flaps are placed in an open or spread position to receive hot melt adhesive. Usually, at least one strip or ribbon of hot melt adhesive is applied to each end of the inner major flap, transverse to its fold line. The outer major flap receives a block C or a block U-shaped strip of hot melt adhesive including a strip at each end perpendicular to its fold line, and a third strip extending longitudinally between the outer strips along the leading edge of the flap generally parallel to its fold line.

The sealing operation is completed by first folding the inner major flap onto the minor flaps beneath. The outer major flap is then folded over the inner major flap, and its U-shaped strip of adhesive contacts the ends and center portion of the exposed surface of the inner major flap beneath. Both the inner and outer major flaps extend across the entire depth of the carton. One example of this method of forming a sift-proof seal at the end flaps of a carton is shown in U.S. Pat. No. 3,831,342.

Sift-proof cartons of the type described above require a substantial amount of cold setting or hot melt adhesive to obtain the desired bond strength and to create a continuous barrier of adhesive between the flaps where product could leak out of the carton. In addition, both of the major flaps in cartons such as disclosed in U.S. Pat. No. 3,831,342 are formed with a width equal to the depth of the carton so that they extend across the entire bottom or top of the carton when folded. This is required to ensure that a continuous bead or barrier of adhesive is formed at the ends of the carton between the outer major flap and the inner major flap.

Another type of sift-proof carton employs shortened or economy inner and outer major flaps to save on carton material. These sift-proof cartons are the same as that shown in U.S. Pat. No. 3,831,342 except the inner and outer major flaps extend only part way across the top or bottom of the box instead of all the way across.

In sealing the end structure of a four-sided, sift-proof carton with economy major flaps, the opposed minor flaps are first folded inwardly toward the center of the carton. The two major flaps are placed in an open or spread position to receive hot melt adhesive. A strip or ribbon of hot melt adhesive is applied to each end of the inner major flap, transverse to its fold line, which is then folded onto the exposed surfaces of the minor flaps. When folded onto the minor flaps, the inner major flap forms a gap or space between its leading edge and the fold line of the outer major flap because the inner major flap extends only part way across the carton. In order to form a sift-proof seal, the gap or space between the leading edge of the inner major flap and fold line of the outer major flap overlying the minor flaps must be filled with adhesive.

It has been the practice in the prior art to form a sift-proof seal in cartons having economy major flaps to dispense a large quantity of hot melt adhesive on the ends of the outer major flap transverse to its fold line so that when the outer major flap is folded into position the hot melt adhesive fills the entire gap overlying the minor flaps between the leading edge of the inner major flap and the fold line of the outer major flap.

The problem with sift-proof seals of the type described above for cartons having economy flaps is that a large quantity of hot melt adhesive must be used to insure that a continuous, sift-proof seal is created in the gap overlying the minor flaps. This is due to the fact that hot melt adhesive has high viscosity and high surface tension which limits its spreadability, as discussed above. In using large quantities of hot melt adhesive, some of the adhesive is squeezed out from between the flaps when the outer major flap is folded in place. This creates either a sloppy looking seal or a seal which requires a further operation to remove the excess adhesive squeezed from underneath the flaps. Such an additional, adhesive removing operation adds to the cost of fabricating sift-proof seals of this type.

One other type of sift-proof seal is a so-called "delta seal" which is widely used to seal sugar bags and similar containers. The flaps of four-sided containers with delta seals include opposed rectangular-shaped flaps and opposed delta or triangular-shaped flaps. In forming a sift-proof container with this flap configuration, one of the rectangular-shaped flaps is folded toward the center of the container and a block C or block U-shaped strip of adhesive is applied to its exposed surface. The other rectangular flap is then folded toward the center of the container onto the adhesive placed on the exposed surface of the first rectangular flap. Each triangular flap receives a strip of adhesive along its outer edge, and the triangular flaps are then folded over the rectangular flap in sequence one after the other. An example of a delta seal for a sugar bag which is sealed by foamed hot melt adhesive is shown in U.S. Pat. No. 4,156,398.

One problem with delta seals is that it is difficult to apply a U-shaped ribbon of adhesive material to the rectangular flap, and then separate strips of adhesive along the angled edges of each triangular flap, in a high speed production run. In addition, each flap of a delta seal must be folded in sequence which further increases the complexity of forming such seals at high rates of speed.

SUMMARY OF THE INVENTION

It is among the objectives of this invention to provide a sift-proof carton and method of fabricating which provides a high strength, sift-proof seal of the flaps at each end of the carton while employing less carton material and less adhesive.

These objectives are accomplished in a carton having flaps which do not extend across the entire depth of the top or bottom of the carton, but which are interconnected in a strong, sift-proof seal by a relatively small quantity of foamed hot melt adhesive material.

In a presently preferred embodiment, a four-sided carton is provided having shortened or economy flaps as described above which comprises opposed minor flaps formed at each end of two opposed sides of the carton, and opposed inner and outer major flaps formed at each end of the other two sides of the carton. All of the flaps are joined to the carton sides at a fold line and include a leading edge opposite the fold line. At least one and preferably both the inner and outer major flaps are formed with a transverse dimension between their fold lines and leading edges which is less than the depth of the bottom or top of the carton.

In forming the carton of this invention, the top and bottom of the carton are sealed in identical fashion in a sequence wherein the bottom flaps are first sealed to permit the carton to be filled with a granular product and the top flaps thereafter sealed to close the carton.

In one method of forming the carton of this invention, each end of the carton is closed and sealed by first folding the minor flaps inwardly from a spread position toward the center of the carton to a folded position substantially parallel with the top of the carton. Foamed hot melt adhesive is then applied with the inner and outer major flaps in their spread or open position. Preferably, a ribbon or strip of foamed hot melt adhesive is applied along each end of the inner major flap transverse to its fold line, which may extend partially onto the minor flaps. The outer major flap receives a strip of foamed hot melt adhesive on each of its ends, transverse to the fold line, which also may extend partially onto the minor flaps. An elongated strip of foamed or non-foamed hot melt adhesive is placed longitudinally between the two outer strips of the outer major flap adjacent its leading edge and substantially parallel to the fold line of the outer major flap.

Alternatively, the foamed hot melt adhesive is applied to the inner and outer major flaps in the same pattern described above prior to folding the minor flaps inwardly from a spread position toward the center of the carton. In this method, the foamed hot melt adhesive strips along each end of the inner and outer major flaps does not extend onto the minor flaps.

In both of the above-described methods, the inner major flap is next folded onto the exposed top surfaces of the minor flaps forming a sift-proof seal at the outer edges of the inner major flap where the foamed hot melt adhesive meets the minor flaps. Since the width of the inner major flap is less than the depth of the bottom of the carton, the leading edge of the inner major flap is spaced from the fold line of the outer major flap forming a gap therebetween along each of the minor flaps beneath.

The sealing operation is completed in both of the above-described methods by folding the outer major flap toward the center of the carton from its spread position to a folded position. The leading edge of the outer major flap contacts a portion of the exposed surface of the inner major flap, and its end portions overlie those portions of the minor flaps in the gap between the leading edge of the inner major flap and the fold line of the outer major flap. The width of the outer major flap is such that the strip of foamed hot melt adhesive placed along its leading edge contacts the exposed surface of the inner major flap forming a sift-proof seal therebetween. In addition, the strips of foamed hot melt adhesive on each end of the outer major flap fill the gaps along the minor flaps between the leading edge of the inner major flap and the fold line of the outer major flap. A sift-proof seal is therefore formed along all four edges of the top or bottom of the carton to seal the contents therein.

One aspect of this invention is that the use of foamed hot melt adhesive substantially reduces the quantity of adhesive required to obtain a sift-proof seal of the end flaps of a carton, compared to prior art cartons sealed with non-foamed hot melt adhesive or cold setting adhesive. The relatively small quantity of foamed adhesive applied to the ends of the outer major transverse to its fold line does not squeeze out from underneath the outer major flap but is spread evenly beneath it and requires no further operation to clean excess adhesive from the edges of the carton.

In addition to the savings of adhesive, the sift-proof carton of this invention is easier to fabricate in a high speed production run and requires less carton material in forming the flaps than in some prior art cartons. As described above, the inner and outer major flaps of the sift-proof carton herein are formed with a width or transverse dimension between their leading edge and fold line which is less than the depth of the bottom or top of the carton. The spaces between the leading edge of the inner major flap and the opposite side of the carton which overlie the minor flaps are filled by the two foamed hot melt adhesive strips applied to opposite ends of the outer major flap. A relatively small quantity of foamed hot melt adhesive thus fills in the portion of the bottom or top of the carton of this invention, which, in some prior art cartons, was occupied by a flap extending across the entire bottom or top of a carton. The top or bottom of the carton herein is thus partially formed by the inner major flap and the minor flaps beneath, and the cellular, foamed hot melt adhesive extending beneath the outer major flap in the gap formed by the inner major flap.

DESCRIPTION OF THE DRAWINGS

The structure, operation and advantages of a presently preferred embodiment of this invention will become further apparent upon consideration of the following description taken in conjunction with the accompanying drawings, wherein.

DETAILED DESCRIPTION OF THE INVENTION

Figure 1:
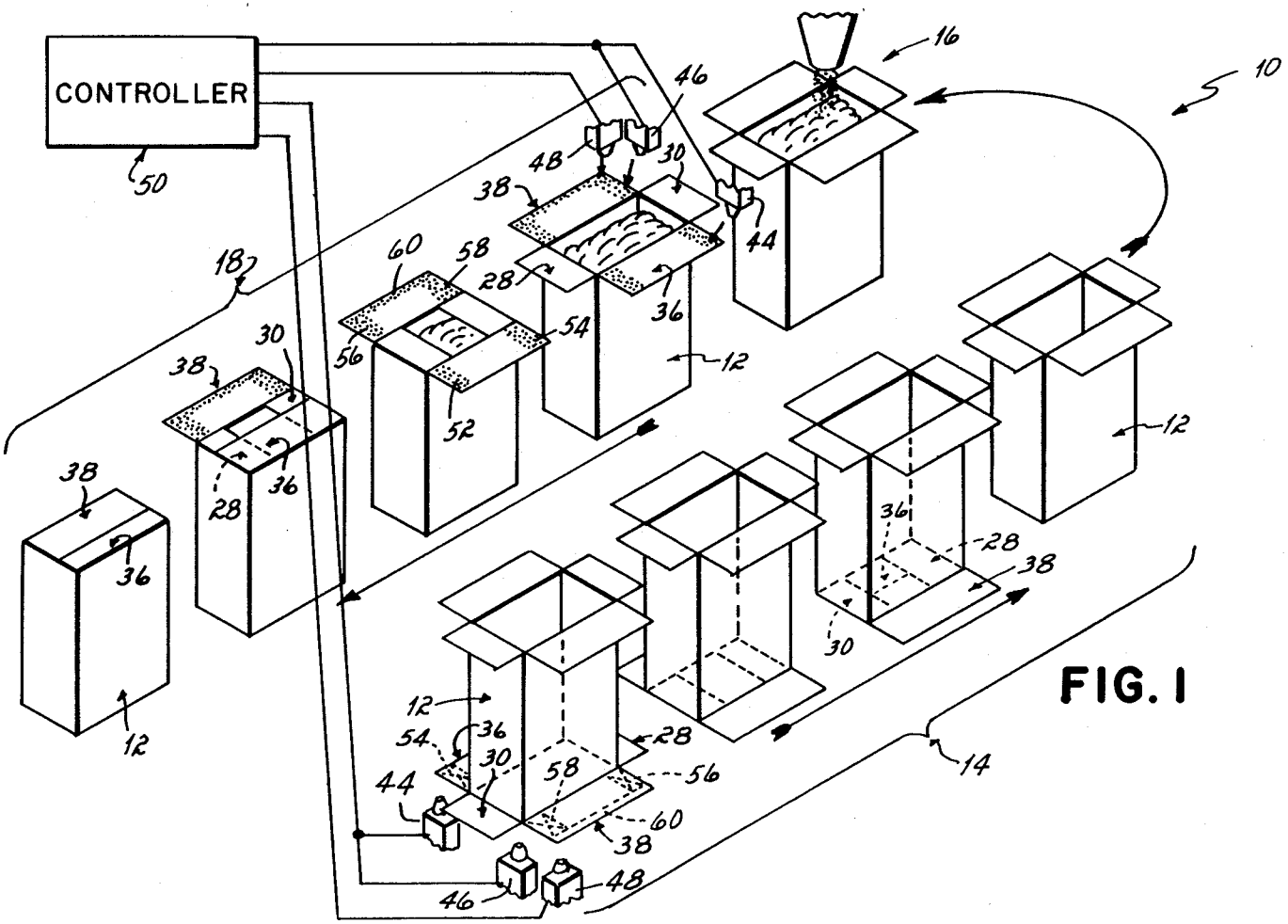
FIG. 1 is a schematic, isometric view of one embodiment of a carton forming and filling operation in which the bottom flaps are first sealed, the carton filled with product and then the top flaps of the carton are sealed.

Referring now to FIG. 1, a schematic view of a carton forming and filling line 10 is illustrated in which the bottom flaps of the cartons 12 of this invention are first sealed at a bottom sealing station 14, the cartons 12 are then filled with product at a filling station 16, and thereafter the top flaps of the carton 12 are sealed at a top sealing station 18. The top and bottom flaps of the carton 12 are sealed with foamed hot melt adhesive produced in accordance with the method described in detail in U.S. Pat. No. 4,059,466, which is dispensed from foamed adhesive dispensing guns of the type such as shown in U.S. Pat. No. 4,396,529. The method of manufacturing foamed hot melt adhesive, the adhesive dispensing guns, the mechanisms for folding the flaps of the carton 12 and the mechanism for filling the carton 12 per se form no part of this invention and are not described in detail herein.

Referring now to FIGS. 2–5, enlarged views are provided of one embodiment of the sequence in which the top of carton 12 is sealed at the top sealing station 18. It should be understood, as illustrated in FIG. 1, that the bottom of carton 12 is sealed in the identical fashion at bottom sealing station 14 and therefore only the sealing of the top of the carton is described in detail herein. The same reference numbers are used for the same flaps at both the top and bottom of carton 12.

Figure 2:
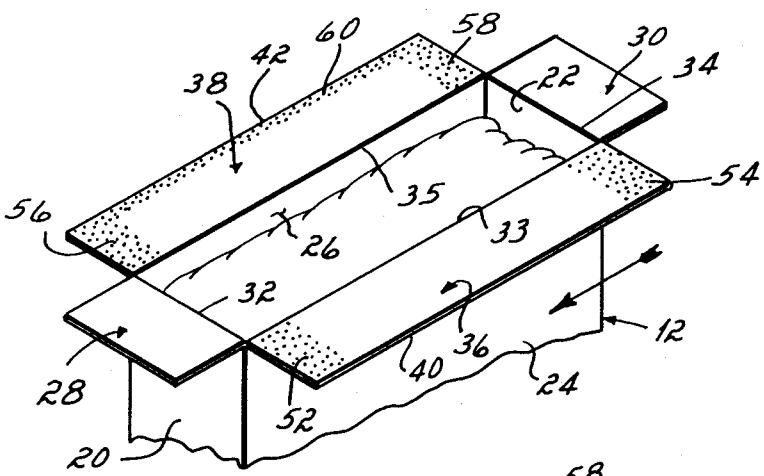
FIG. 2 is an enlarged isometric view of a portion of the top of the carton herein at the station where the top flaps are sealed.

As shown in FIGS. 1 and 2, the carton 12 consists of two opposed sides 20, 22, whose width defines the depth of the carton 12, connected to two opposed sides 24, 26. The top flaps of carton 12 include opposed minor flaps 28, 30 connected at fold lines 32, 34 to the sides 20, 22, respectively. The other two sides 24, 26 of carton 12 are connected at fold lines 33, 35 to an inner, major flap 36 and an outer major flap 38, respectively. The inner and outer major flaps 36, 38 each have a leading edge 40, 42, respectively, opposite their fold lines 33, 35.

As shown in FIG. 2, the top flaps 28, 30, 36 and 38 are presented in an open or spread position beneath three adhesive dispensing guns 44, 46 and 48 mounted at the top sealing station 18. The operation of the adhesive guns 44, 46 and 48 is controlled in a conventional manner by a controller 50 which opens and closes them in a timed sequence. As the carton 12 moves along the top sealing station 18 in the direction of the arrow shown in FIG. 1, adhesive gun 44 is first activated to apply a ribbon or strip 52 of foamed hot melt adhesive upon one end of inner major flap 36, closed for a predetermined period of time and then activated to apply a second strip 54 of foamed hot melt adhesive on the opposite end of inner major flap 36. Preferably, the strips 52, 54 are oriented on the outer ends of inner major flap 36 generally transverse to its fold line 33.

Adhesive gun 46 is operated in the identical manner as gun 44 to apply spaced strips 56, 58 of foamed hot melt adhesive on opposite ends of outer major flap 38, transverse to its fold line 35. The third gun 48 is operated to apply an elongated strip 60 of foamed hot melt adhesive between the outer strips 56, 58 on the outer major flap 38 adjacent its leading edge 42 and generally parallel to fold line 35 to form a block C or block U-shaped adhesive strip.

Figure 3:
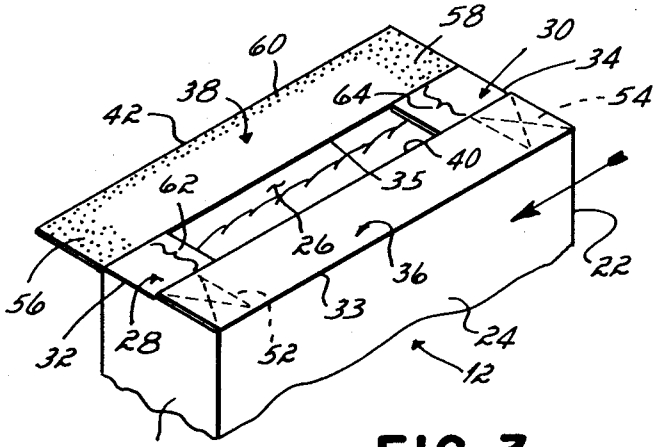
FIG. 3 is an enlarged isometric view of the top flaps in a partially folded position.
Figure 5:
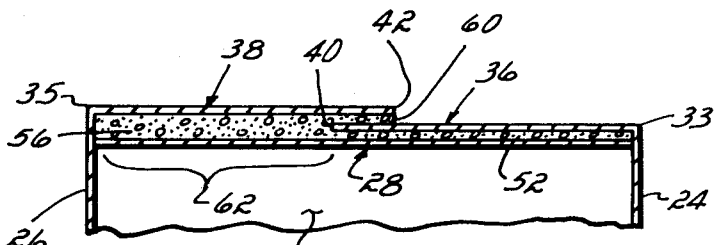
FIG. 5 is an enlarged cross sectional view taken generally along line 5—5 of FIG. 4 showing the flaps interconnected in a sift-proof seal according to this invention.
Figure 4:
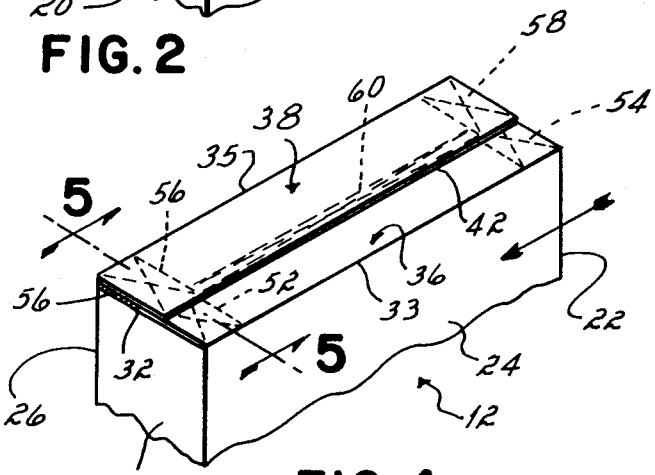
FIG. 4 is an isometric view of the sealed top flaps of the carton herein.

With the foamed hot melt adhesive applied to the top flaps of the carton 12 in the manner described above, the top of the carton 12 is then closed with a sift-proof seal as illustrated in FIGS. 3–5. First, the minor flaps 28, 30 are folded inwardly toward the center of carton 12 from their spread position shown in FIG. 2, to a folded position shown in FIG. 3.

The next step in the flap sealing operation is to fold inner major flap 36 from its open or spread position onto the exposed surfaces of the minor flaps 28, 30 beneath. The adhesive strips 52, 54 applied to the ends of inner major flap 36 contact the exposed surfaces of minor flaps 28, 30, respectively, and create a sift-proof seal therebetween. As noted above, the width of inner major flap 36, or the transverse dimension between its fold line 33 and leading edge 40, is less than the depth of the top of carton 12 so that the inner major flap 36 extends only part way thereacross. This forms a space 62 which overlies the minor flap 28 and a space 64 overlying the minor flap 30, both of which extend between the leading edge 40 of inner major flap 36 and the fold line 35 of outer major flap 38.

The flap sealing operation is completed by folding the outer major flap 38 from its open or spread position to a closed position as shown in Figs. 4 and 5. In the closed position, the leading edge 40 of outer major flap 38 extends atop an exposed portion of the inner major flap 36 so that the adhesive strip 60 applied adjacent the leading edge 42 of outer major flap 38 forms a sift-proof seal with the inner major flap 36 thereat. The adhesive strips 56, 58 applied to opposite ends of the outer major flap 38 contact the minor flaps 28, 30, respectively, and fill the gaps or spaces 62, 64 between the leading edge 40 of inner major flap 36 and the fold line 35 of outer major flap 38.

The top of carton 12 is thus formed with the sift-proof seal illustrated in FIG. 5. The righthand portion of the top of carton 12, as viewed in FIG. 5, consists of the inner major flap 36 folded directly upon the minor flap 28 with a relatively thin layer or strip 52 of foamed hot melt adhesive therebetween. Preferably, adhesive gun 44 is operated by the controller 50 to dispense a relatively small amount of foamed hot melt adhesive to form thin strips 52, 54, since the inner major flap 36 rests essentially directly upon the minor flaps 28, 30.

The sift-proof seal formed at the lefthand portion of the top of carton 12, as viewed in FIG. 5, consists primarily of cellular, foamed hot melt adhesive. Since the inner major flap 36 stops short of the opposite side 28 of the carton 12 forming a space 62 therebetween, and the outer major flap 38 overlaps the inner major flap 36, a relatively large gap is formed between the outer major flap 38 and the minor flap 28 beneath. A gap of the same size is formed at the opposite side of outer major flap 38 at the minor flap 30. Both of these gaps must be completely filled with foamed hot melt adhesive to provide a sift-proof seal at the ends of the carton 12.

Due to the relatively low viscosity and good spreadability characteristics of foamed hot melt adhesive, such gaps are easily filled by a relatively small quantity of foamed adhesive without the adhesive squeezing outwardly from underneath the outer major flap 38 along the edges of the carton 12. Preferably, a somewhat greater amount of foamed hot melt adhesive is dispensed from adhesive gun 48 than from adhesive gun 44 to provide the additional foamed adhesive needed to fill the gaps beneath outer major flap 38. Neither the inner major flap 36 nor the outer major flap 38 therefore need extend across the entire top or bottom of carton 12 in order to achieve a sift-proof seal which also exhibits the required bond strength.

Figure 6:
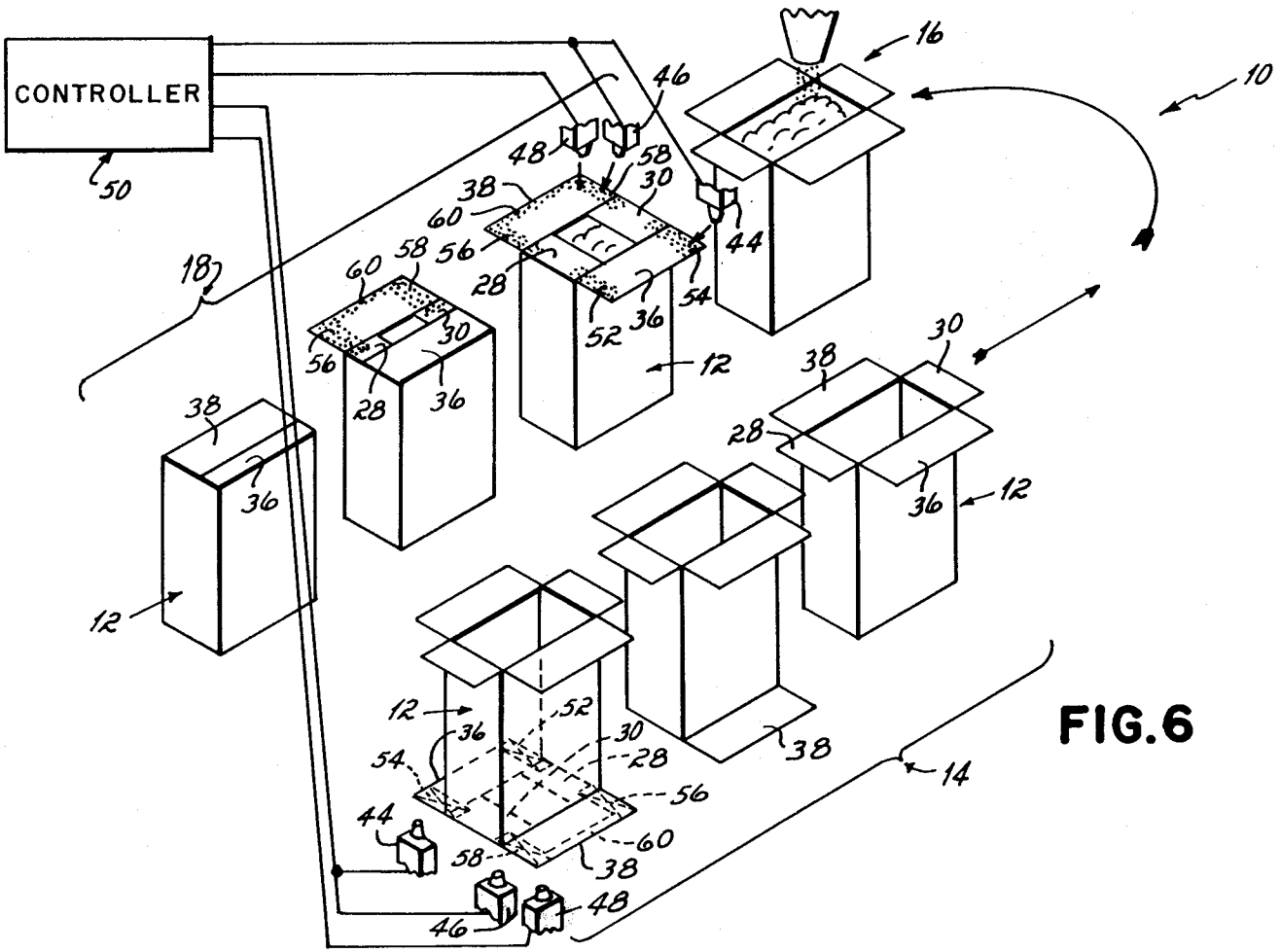
FIG. 6 is a schematic, isometric view of an alternative embodiment to that shown in FIG. 1 illustrating a carton forming and filling operation in which the bottom flaps are first sealed, the carton filled with product and then the top flaps of the carton are sealed.

Referring now to FIG. 6, an alternative embodiment of the method of sealing the flaps of carton 12 is illustrated. In this embodiment, the top flaps 28, 30, 36 and 38 are presented in an open or spread position at the product filling station 16 to receive product within the carton 12. The minor flaps 28, 30 are then folded inwardly toward the center of the carton while the inner and outer major flaps 36, 38 are maintained in an open or spread position. The carton 12 is then moved to a position beneath the adhesive dispensing guns 44, 46, 48 at the top sealing station 18. The ribbons or strips of adhesive 52–60 are applied by the adhesive guns 44, 46 and 48 in a manner substantially identical to that described in the embodiment of FIGS. 1–5. The one difference in the adhesive application of this embodiment, however, is that the transverse strips of adhesive 52, 56 on one side of the carton 12 may extend partially onto the minor flap 28, and the transverse adhesive strips 54, 58 on the opposite side of the carton 12 may extend partially onto the folded minor flap 30.

Sealing of the top flaps 28–38 of the carton 12 then proceeds in the same fashion described above. The inner major flap 36 is folded onto the minor flaps 28, 30, and the outer major flap is then folded onto a portion of the minor flaps 28, 30 and the folded inner major flap 36. The identical sift-proof seal described above and illustrated in FIGS. 4 and 5 is obtained with the method of forming carton 12 illustrated in FIG. 6.

While the invention has been described with reference to a preferred embodiment, it will be understood by those skilled in the art that various changes may be made and equivalents may be substituted for elements thereof without departing from the scope of the invention.

In addition, many modifications may be made to adapt to a particular situation or material to the teachings of the invention without departing from the essential scope thereof. For example, it is contemplated that in some applications the elongated strip 60 on the outer major flap 38 parallel to its fold line 35 could be nonfoamed hot melt adhesive instead of foamed adhesive, with all other adhesive strips being formed of foamed adhesive.

Therefore, it is intended that the invention not be limited to the particular embodiment disclosed as the best mode contemplated for carrying out this invention, but that the invention will include all embodiments falling within the scope of the appended claims.

What is claimed is:

1. A method of sealing the ends of a four-sided sift-proof carton, each end of the carton having a pair of spaced minor flaps, an inner major flap and an outer major flap spaced from said inner major flap, each of said minor flaps and said inner and outer major flaps being formed with opposed ends, a fold line joining a side of the carton and a leading edge opposite said fold line, the spacing between said inner major flaps and said outer major flaps at the fold lines of the carton defining the depth of the carton, comprising:

folding said spaced minor flaps from a spread position inwardly toward the center of the carton forming an exposed surface on each of said minor flaps between said fold line and said leading edge thereof;

dispensing a strip of foamed adhesive material onto each of said opposed ends of said inner major flap between said fold line and said leading edge thereof with said inner major flap in a spread position relative to the sides of the carton;

dispensing a first strip of foamed adhesive material onto each of said opposed ends of said outer major flap between said fold line and said leading edge thereof, and a second strip of adhesive material onto said outer major flap between said first strips with said outer major flap in a spread position relative to the sides of the carton;

folding said inner major flap from said spread position toward the center of the carton so that said strips of foamed adhesive material on said inner major flap contact said exposed surfaces of said pair of minor flaps, said inner major flap having a width dimension between said leading edge and said fold line thereof which is substantially less than said depth of the carton so that a large gap is formed on said exposed surface of each of said minor flaps between said leading edge of said inner major flap and said fold line of said outer major flap with said inner major flap folded toward the center of the carton;

folding said outer major flap toward the center of the carton so that said first strip of foamed adhesive material on each end of said outer major flap contacts said exposed surface of one of said pair of minor flaps and said second strip of adhesive material contacts said inner major flap, said first strips of foamed adhesive material on said outer major flap filling said gaps on said exposed surfaces of said minor flaps between said leading edge of said inner major flap and said fold line of said outer major flap to form a sift-proof seal thereat.

2. The method of claim 1 in which said step of folding a pair of opposed minor flaps is performed after said step of dispensing a strip of foamed adhesive material onto each end of said inner major flap and after said step of dispensing first and second strips of adhesive material onto said outer major flap.

3. The method of claim 1 in which said step of folding a pair of opposed minor flaps is performed before said step of dispensing a strip of foamed adhesive material onto each end of said inner major flap and said step of dispensing first and second strips of adhesive material onto said outer major flap, said exposed surfaces of said opposed minor flaps being at least partially covered by said strips of foamed adhesive material dispensed onto each end of said inner major flap and by said first strips of adhesive material dispensed onto said outer major flap.

4. A four-sided, sift-proof carton having height, width and depth dimensions comprising:

a pair of spaced minor flaps formed at each end of two opposed sides of the carton, said minor flaps each being foldable along fold lines at the sides of the carton from a spread position inwardly toward the center of the carton to a folded position forming exposed surfaces on said minor flaps;

spaced inner and outer major flaps formed at each end of the other two sides of the carton, said inner and outer major flaps each having a fold line at the sides of the carton and a leading edge, the transverse dimension between said fold line and said leading edge of each of said inner and outer major flaps being substantially less than the depth dimension of the carton which extends between said fold line of said inner major flaps and said fold line of said outer major flaps;

said inner major flaps each being adapted to receive a strip of foamed adhesive material on each end which extends between said fold line and said leading edge thereof, said inner major flaps being foldable inwardly from a spread position relative to the sides of the carton to a folded position so that said strips of foamed adhesive material at each end contact said exposed surfaces on said minor flaps and form a sift-proof seal therebetween;

said inner major flaps at each end of the carton forming a substantial gap along said exposed surfaces of said minor flaps between said leading edge of said inner major flaps and said fold line of said outer major flaps with said inner major flaps in said folded position;

said outer major flaps at each end of the carton being adapted to receive a first strip of foamed adhesive material on each end which extends between said fold line and said leading edge thereof, and a second strip of adhesive material between said first strips which extends parallel to said fold line, said outer major flaps each being foldable from a spread position relative to the sides of the carton inwardly toward the center of the carton to a folded position so that said second strip of adhesive material contacts said inner major flaps forming a sift-proof seal thereat, and so that said first strips of foamed adhesive material contact said exposed surfaces of said minor flaps to fill said gap along said minor flaps between said leading edge of said inner major flap and said fold line of said outer major flap to form a sift-proof seal therebetween.

* * * * *